United States Patent [19]

Lemaire et al.

[11] Patent Number: 4,585,079

[45] Date of Patent: Apr. 29, 1986

[54] METHOD AND A MACHINE FOR HANDLING DRILL PIPES

[75] Inventors: Marc Lemaire, Carquefou; Roland Le Roc'h, St-Sebastien sur Loire, both of France

[73] Assignee: Brissonneau et Lotz Marine, Carquefou-Nantes, France

[21] Appl. No.: 489,463

[22] Filed: Apr. 28, 1983

[30] Foreign Application Priority Data

Apr. 30, 1982 [FR] France ..... 82 07538

[51] Int. Cl.[4] ..... E21B 3/04

[52] U.S. Cl. ..... 173/164; 81/57.19; 188/67

[58] Field of Search ..... 188/67; 173/163, 164; 166/382, 385; 81/57.15, 57.16, 57.19, 57.21, 57.33, 57.35; 294/102.2, 90

[56] References Cited

U.S. PATENT DOCUMENTS

| | | | |
|---|---|---|---|
| 2,410,589 | 11/1946 | Segelhorst | 166/16 |
| 2,636,241 | 4/1953 | Liljestrand | 24/263 |
| 2,814,461 | 11/1957 | Martin | 255/23 |
| 3,158,213 | 11/1964 | O'Neill et al. | 175/85 |
| 3,194,313 | 7/1965 | Fanshawe | 166/77.5 |
| 3,270,389 | 9/1966 | Kingsbury | 24/263 |
| 3,579,753 | 5/1971 | Pryor | 188/67 |
| 3,961,399 | 6/1976 | Boyadjieff | 188/67 |
| 4,023,449 | 5/1977 | Boyadjieff | 81/57.16 |
| 4,116,015 | 9/1978 | Duncan | 81/57.2 |
| 4,253,219 | 3/1981 | Krasnov | 188/67 |
| 4,306,339 | 12/1981 | Ward | 24/263 |

FOREIGN PATENT DOCUMENTS

| | | |
|---|---|---|
| 1521103 | 4/1967 | France . |
| 2065728 | 8/1971 | France . |
| 2081840 | 12/1971 | France . |
| 2301683 | 2/1976 | France . |

*Primary Examiner*—James M. Meister
*Assistant Examiner*—James Wolfe
*Attorney, Agent, or Firm*—Shapiro and Shapiro

[57] ABSTRACT

A machine applies screwing and unscrewing torque between successive drill pipes with an essentially vertical axis extending through a tapered opening in a turntable for a well bore. The machine includes a mechanism for applying a high initial unthreading torque and a high final threading torque between successive drill pipes and a mechanism for rapid screwing and unscrewing of successive drill pipes. The machine also includes a clamping mechanism having a bolster and a plurality of shims. The shims have outer portions tapered to fit into the opening of the turntable and have inner portions with a shape corresponding to the shape of the drill pipes. Each shim is supported individually on the bolster by a device that moves the shim into engagement with a drill pipe to grip the same and with sufficient freedom to permit the shims to center the pipe between them automatically. The bolster is lowered to cause the shims to enter the opening in the turntable.

4 Claims, 5 Drawing Figures

METHOD AND A MACHINE FOR HANDLING DRILL PIPES

Figure 1:
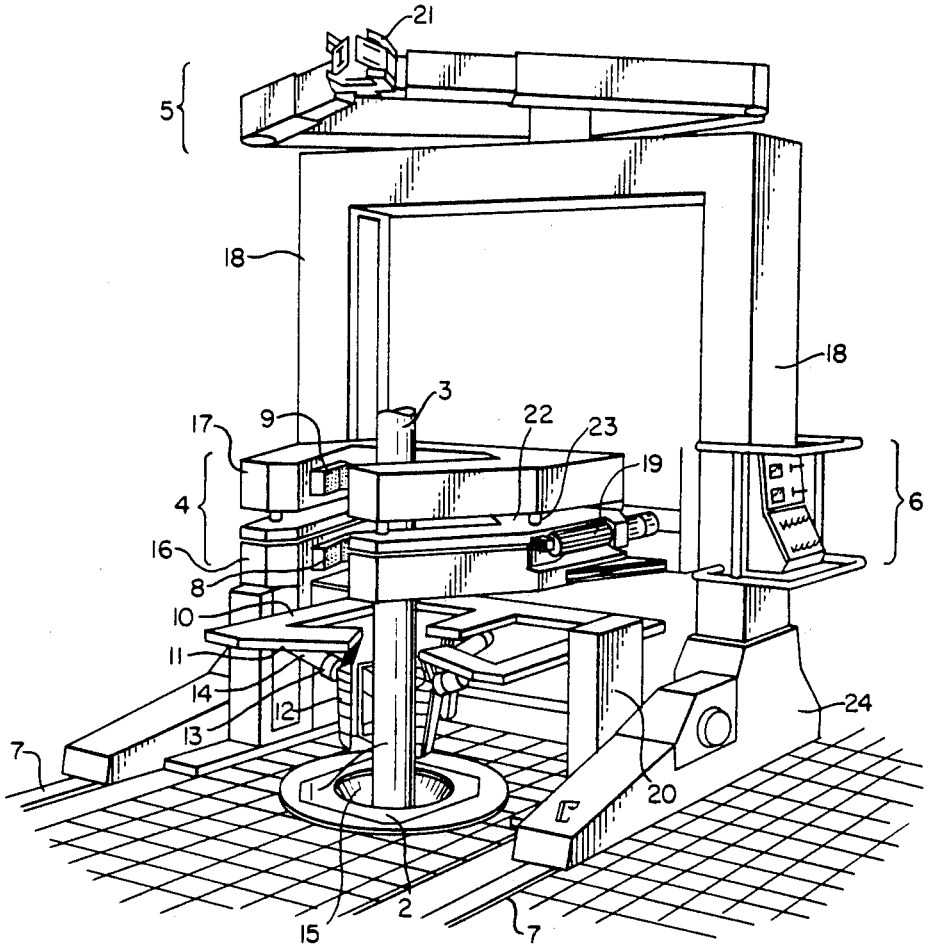

The present invention pertains to a method and to a machine for handling drill pipes with an essentially vertical axis, and, in a more specific form, this invention pertains to a fully automatic unit operating in accordance with the aforementioned method.

Machines which are intended to allow rapid handling of strings of drill pipes have been developed heretofore, such as the machine described within French Pat. No. 2,301,683, although these machines are characterized by the disadvantage of being unsuited for providing fully automatic functioning on account of their design.

Nevertheless, handling of drill pipes a considerable number of times in succession is required when it is necessary, for example, to lift several thousand meters of drill pipes, or to change bits placed at the ends of sets of drill pipes, or to perform measurements within shafts, or to coffer shafts and then to lower the drill pipes again. Hence, it is clear that it is highly desirable to render successive handling procedures automatic.

The present method for handling a string of drill pipes with an essentially vertical axis at the level of a turntable for a well bore permits raising or lowering of drill pipes, with the bottom end of each pipe possessing a threaded male conical section, whereas the uppermost end possesses a corresponding threaded female conical section. It is possible to apply this particular method by means of: a machine outfitted with a clamping mechanism containing shims whose outer portions are in the form of sections of the frustum of a cone and can be fitted into an opening with a corresponding shape which has been provided within the aforementioned turntable for this purpose, whereas the inner portions are in the form of cylindrical sections, corresponding to the shape of a drill pipe; a mechanism which provides a high initial torque for unscrewing procedures; a mechanism for rapid unscrewing procedures; and a positioning clamp.

In accordance with the present invention, procedures for raising drill pipes include the following steps:

Shims attached to respective arms connected to a bolster which can be shifted vertically, by means of a joint and a jack supported by a given arm, are initially pressed against a drill pipe extending partially above the turntable. Each shim whose position is to be regulated by said mechanism shall be pressed against the drill pipe in a manner permitting automatic centering of the shim. Then the bolster is lowered so as to ensure firm gripping of the drill pipe by the shims, by causing the shims to be fitted into an opening with a corresponding shape.

Gripping devices situated upon the two clamps located one above the other on the mechanism which provides a high initial torque are then positioned so as to grip the upper end of the lower drill pipe and the lower end of the upper drill pipe, respectively. Then one of the clamps must be turned approximately 30° around the axis of the drill pipes, and the gripping devices are subsequently released, with the clamps returning to a disengaged position.

The mechanism for rapid unscrewing is placed in operation, and the positioning clamp guides the drill pipe to the location where it shall be stored.

Lastly, the bolster is returned to its original position, and the jacks are loosened, while the drill pipe remains in a separate location.

Procedures for lowering drill pipes consist of the following steps:

Shims attached to respective arms connected to a bolster which can be shifted vertically, by means of a joint and a jack supported by a given arm, are initially applied to a drill pipe extending partially above the turntable. Each shim whose position is to be regulated by said mechanism shall be pressed against the drill pipe in a manner permitting automatic centering of the shim. Then the bolster is lowered so as to ensure firm gripping of the drill pipe by the shims, by causing the shims to be fitted into an opening with a corresponding shape.

The drill pipe which is to be screwed into position is secured by means of the positioning clamp, and the mechanism for rapidly screwing drill pipes into position is placed in operation.

Gripping devices situated upon the two clamps located one above the other on the mechanism which provides a high final torque are then placed so as to grip the upper end of the lower drill pipe and the lower end of the upper drill pipe, respectively. One of these clamps is then turned approximately 30° around the axis of the drill pipes, and the gripping devices are subsequently released, with the clamps returning to a disengaged position.

The bolster is returned to its original position, and the jacks are loosened, while the drill pipe remains in a separate location.

It is preferable for the machinery for applying the previously cited procedures to possess the following characteristics, in a separate form or in a combined form:

Each shim is fastened to an arm connected to a bolster which is capable of moving vertically, by means of at least one joint and at least one jack supported by said arm, in order for the shim whose position is regulated by this mechanism to be pressed against the drill pipe so as to permit automatic centering of the shim.

Each shim is fastened to a respective arm by means of a stay, as a result of a jointed arrangement;

The bolster is supported by struts which include a counterweight-and-spring mechanism, in such a manner that the disengaged position for said bolster shall be the raised position, with the shims situated outside the opening possessing a corresponding shape;

There are three shims and three arms, respectively.

The jack and the stay are supported upon the shim by means of a shoe which can be detached from the shim;

The two clamps are arranged one above the other, and they are outfitted with gripping devices which are controlled by the previously cited jacks. These gripping devices respectively grip the top end of the bottom drill pipe and the bottom end of the top drill pipe, with one of the clamps being secured to a truss in a stationary form, whereas the other clamp is capable of being turned around the axis of the drill pipes, by means of a jack which is connected to both the lower clamp and the upper clamp.

Each gripping device includes three components which are essentially situated at the corner positions of an equilateral triangle, with two of said components being placed at respective ends of each leg of the clamp, while the third component is placed at the rear portion of said clamp.

An opening is provided within the thickness portion of one of the clamps when the machine is not providing torque for performing screwing or unscrewing procedures.

Each leg of the clamp possesses an essentially square shape, with a guide mechanism being situated between the side walls of moving parts identified as (91) and (93) and the aforementioned leg.

It shall be possible to obtain fuller understanding of the present invention, as well as other purposes, advantages, and characteristics of said invention, in relation to the subsequent description of a preferred version constituting a non-restrictive example of said invention, with two pages of illustrations having been provided.

FIG. 1 provides a schematic cut away view of an automatic machine for completing the procedures to which the present invention pertains.

FIGS. 2 through 5 provide schematic representations of specific components of the machine shown in FIG. 1.

The automatic machine appearing in FIG. 1 includes various assemblies which operate in conjunction with one another. Specifically, it includes a mechanism allowing secure gripping of a drill pipe (1), which extends from the well bore at the level of the turntable (2); it also includes a mechanism (4) which provides initial or final torque for unscrewing or screwing a second drill pipe (3) which is partially visible within FIG. 1, with the top of said drill pipe extending upward; and it likewise includes a mechanism for rapid screwing or unscrewing of drill pipes, which does not appear within the drawing, as well as a positioning clamp (5) for drill pipes and a control unit which, in this instance, is represented by a control panel (6). The aforementioned machine is mounted so that it can be shifted along rails (7) provided for this purpose.

Usually, when it is necessary to lift a string of drill pipes out of a shaft, the drill pipes are detached from one another and are stored on the platform of the drilling unit. For this purpose, the string of drill pipes is lifted in a manner whereby components of the upper gripping device on the machine shall grip the pipe which is to be unscrewed, in order to apply torque, with the bottom drill pipe being gripped by components of the lower gripping device (8) on the same machine.

Nevertheless, when it is necessary to secure the bottom drill pipe (1) so as to prevent the remaining drill pipes from falling into the shaft subsequent to unscrewing of the top drill pipe, the string of drill pipes must be lifted higher at the outset, in order to permit gripping of the bottom drill pipe (1) by the clamping mechanism. This mechanism consists of a bolster (10) outfitted with arms (11), to which shims (12) are attached by means of joints (13) and jacks (14), and it is possible for said bolster to be shifted vertically. When the jacks (14) are placed in operation, there is initial contact between the shims (12) and the drill pipe (1), with automatic centering of shims also being permitted. The bolster (10) is permitted to descend, by gravity, for example, as a result of the weight of the string of drill pipes, and the shims (12) fit into an opening (15) possessing a corresponding shape, which is situated within the turntable (2). In this way, the shims (12) are pressed firmly against the drill pipe (1), whose top end possesses a larger diameter than the remainder of the drill pipe, as an additional safety factor, thereby permitting secure positioning of the drill pipe (1).

When the shims (12) are fitted into the opening (15) and the drill pipe (1) is fully secured, it is possible to operate the machine (4) so as to provide initial torque for turning the top drill pipe (3) according to an angle of approximately 30° in relation to the bottom drill pipe (1), in order to begin the unscrewing procedure.

It has been indicated that the bottom end of each drill pipe possesses a threaded male conical section, whereas the top end possesses a corresponding threaded female conical section. The machine contains two clamps (16, 17) situated one above the other, with each clamp containing gripping devices respectively identified as (8) and (9), whose components are operated by jacks situated within said clamps, although these jacks are not shown in the drawing. The aforementioned gripping devices (8, 9) respectively grip the uppermost end of the bottom drill pipe (1) and the bottom end of the top drill pipe (3). Each gripping device consists of three components which are essentially arranged so as to constitute corners of an equilateral triangle. Two of these components are placed at respective ends of legs of the clamp, whereas the third component situated at the rear of the clamp allows centering of the drill pipe, and, in conjunction with the other components, operates so as to provide the required torque.

The bottom clamp (16), which is stationary, is integral with the truss identified as (18), whereas the top clamp (17) can be turned around the axis of the drill pipe (3) by means of at least one jack (19). One end of the jack is attached to the bottom clamp (16), and the other end is attached to the top clamp (17). Preferably, there are two jacks. In order to allow proper positioning, it is possible to shift both clamps crosswise in relation to the axis of the drill pipes.

During operation, when the shims (12) are properly positioned within the opening (15), the gripping devices (8, 9) initially grip the drill pipes in the manner indicated heretofore. The jack (19) then causes turning of the clamps (16, 17) by approximately 30°. After the unscrewing procedure has begun, with application of the required torque, the entire assembly returns to a disengaged position, firstly with respect to the gripping devices (8, 9), and then with respect to the jack (19).

It is then possible to operate the mechanism for rapid unscrewing. This mechanism does not appear within the drawing, because it is entirely familiar to persons employed in this industry.

Subsequently, the positioning clamp (5) for drill pipes is placed upon the unscrewed drill pipe (3), in order to guide it toward a storage location. The weight of the drill pipe can be supported in the traditional manner, by means of cable which is wound onto the drum of a winch not indicated within the drawing.

The aforementioned cable is then attached to the drill pipe (1), which is still secured by the shims (12). This drill pipe (1) can then be lifted by means of the winch, in order that it may be moved into the position initially occupied by the other drill pipe (3) and in order to begin the cycle again. When the first drill pipe (1) is lifted, the shims (12) move out of the opening (12). The jacks (14) then resume a disengaged position, and the shims are fully disengaged from the drill pipe (1). An entirely conventional counterweight-and-spring system which is not shown in the drawing is situated among the struts which support the bolster (10), so that, when this system is not in use, the bolster is in an uplifted position, and the entire assembly is ready for subsequent procedures.

It is therefore possible to observe that unscrewing procedures can be rendered automatic in an extremely simple form, thereby permitting a considerable reduction in personnel for the operating crew, whose members, in addition, would no longer be required to perform physical labor.

The same observation is applicable for the opposite set of procedures, namely screwing drill pipes into position.

The drill pipe which is to be screwed into position (3) is placed above the drill pipe (3) which extends from the turntable (2), by means of a supporting cable and by means of the positioning clamp (5). The gripping devices (21) on said clamp possess sufficient dimensions to permit proper alignment of both drill pipes by the clamp. The male end of the top pipe (3) is fitted into the female end of the bottom pipe (1) by operating the winch.

The mechanism for rapidly screwing drill pipes into position is then operated with visual monitoring by the operator, through an opening (22) situated within the thickness portion of the top clamp (17) on the mechanism which provides final torque for screwing drill pipes into position. Upon completion of this step, the previously cited opening (22) is eliminated when jacks which are not shown in the drawing assume a disengaged position. These jacks operate fingers identified as (23) so as to allow slight lifting of a portion of the uppermost clamp (17) during the rapid screwing procedure, in order to permit visual monitoring by the operator. Subsequently, the gripping devices (8, 9) respectively grip the top end of the bottom drill pipe (1) and the bottom end of the top drill pipe (3). Additional rotary motion is transferred to the top drill pipe (3), by means of a jack (19), so as to apply torque for screwing this drill pipe tightly into position. Then the jacks successively return to disengaged positions, and the opening (22) within the top clamp (17) is restored.

By means of the cable and the winch, the string of drill pipes can then be lifted high enough to permit removal of the shims (12) from the opening (15) situated within the turntable (2), and the bolster (10) automatically returns to a raised position, as indicated heretofore, while the jacks identified as (14) remain in a disengaged position. Subsequently, it is possible for the operator to lower the string of pipes which has been assembled in this manner, from such a height that, when the shims (12) are to be repositioned for subsequent procedures, the top end of the drill pipe identified as (3), which shall now occupy the position formerly occupied by the drill pipe identified as (1), shall be situated opposite the gripping devices (8) on the bottom clamp (16). It is then possible to repeat these procedures with another topmost drill pipe.

In order to provide an open area when it is unnecessary to screw or to unscrew drill pipes within a set, the entire machine is mounted upon a carriage (24) which possesses the shape of a rectangle which is open on one side. This carriage can be shifted upon rails (7) provided for this purpose on the drilling platform, on both sides of the turntable (7).

It is preferable for the struts (18) supporting the mechanism for applying torque and the mechanism for screwing or unscrewing drill pipes to be mounted so that they can turn several degrees in relation to a joint situated within the aforementioned carriage (24), in order to permit operation of the machine if the axis of the well, and, hence, the axis of the drill pipes, is not precisely vertical and forms a relatively small angle, for example 5°, with the vertical axis.

Lastly, the machine is designed in such a manner that one of the sides is open, so as to permit positioning of the machine, and it is unnecessary to close this portion after the machine has been installed.

Figure 2:
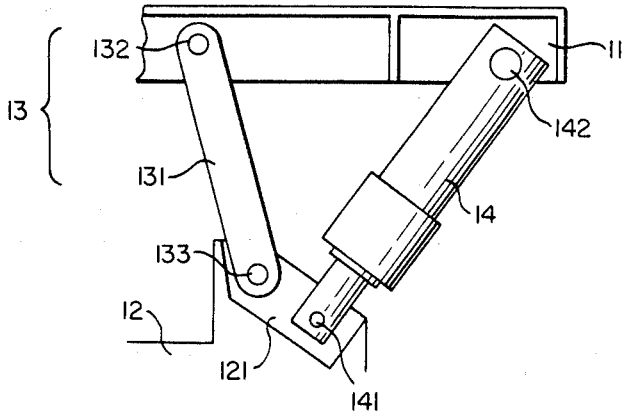
Figure 3:
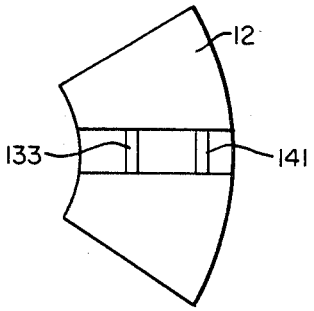
Figure 4:
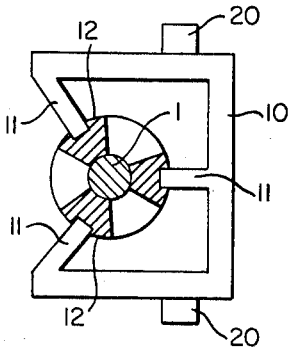

At this point, it is appropriate to describe with greater precision the locking mechanism for the bottom drill pipe, in relation to FIGS. 2 through 4. As has been indicated, this mechanism consists of a bolster (10) which is outfitted with three arms (11), according to the example shown in the drawing. A shim (12) is attached to the end of each arm by at least one joint (13) and at least one jack (14).

FIG. 2 provides a cut away view of the end of one of said arms (11) and the means of attachment for the shim (12). It is possible to observe that one end of the jack (14) is attached to an arm (11), while the other end is attached to the shim (12), by means of joints (141 and 142). In this instance, the joint identified as (13) is a double joint consisting of a stay (131) fastened to the shim (12) at both ends and to the arm (11), by means of joints identified as (132 and 133). Therefore, when the jack (14) functions, the shim (12) is brought into contact with the drill pipe (1), and it can be centered automatically.

FIG. 3 provides an overhead view of a shim, with the joints (133, 141) shown in a more clearly visible form.

FIG. 4 is a schematic overhead view of the bolster (10) and of the opening which permits the mechanism to be positioned above the turntable (2). The shims (12) are shown in contact with the drill pipe (1), which is represented in a cut away form.

Figure 5:
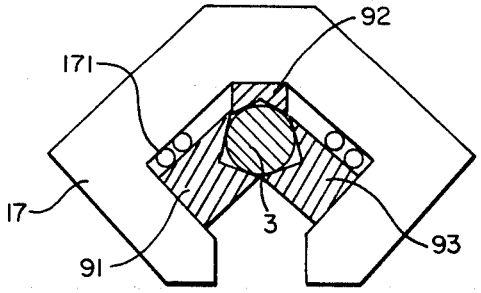

FIG. 5 provides a schematic overhead view of a clamp (17) with a closed gripping device consisting of three components (91, 92, and 93), which essentially form the corners of an equilateral triangle.

It is preferable for the component identified as (92) to be stationary, whereas the components identified as (91) and (93) are controlled by jacks.

Each leg of the clamp possesses a rectangular shape, so that the side walls of the movable components (91, 93) shall be parallel to the legs. In this way, a device (171) which guides these components so as to prevent improper centering of the drill pipe can be placed between the aforementioned side walls and legs.

Although only one version of the present invention has been described, it is obvious that any modifications introduced for similar purposes by technically knowledgeable persons would not constitute departures from the context of this invention.

We claim:

1. A machine to apply screwing and unscrewing torque between successive drill pipes and the like with an essentially veritcal axis extending through a tapered opening in a turntable for a well bore, each pipe being provided at opposite ends with threaded portions for connecting the pipe to adjacent pipes, said machine having, in combination, means for applying a high initial unthreading torque and a high final threading torque between successive drill pipes, means for rapid screwing and unscrewing of successive drill pipes, and a clamping mechanism including a bolster and a plurality of shims, said shims having outer portions tapered to fit into said opening of said turntable and having inner portions with a shape corresponding to the shape of the drill pipes, each shim being supported individually on the bolster by powered means for moving the shim into engagement with a drill pipe to grip the same and with sufficient freedom to permit the shims to center the pipe between them automatically, and means for lowering the bolster to cause the shims already gripping the pipe to enter the opening in the turntable, and wherein said powered means for supporting each shim individually comprises a jack and a link, one end of the jack and one end of the link being pivotally connected to the bolster and the other end of the jack and the other end of the link being pivotally connected to the shim.

2. A machine in accordance with claim 1, wherein said other ends of the jack and link are pivotally connected to the shim by means of a shoe detachable from the shim.

3. A machine in accordance with claim 1, further comprising a positioning clamp for moving a drill pipe toward or away from a succeeding drill pipe.

4. A machine to apply screwing and unscrewing torque between successive drill pipes and the like with an essentially vertical axis extending through a tapered opening in a turntable for a well bore, each pipe being provided at opposite ends with threaded portions for connecting the pipe to adjacent pipes, said machine having, in combination, means for applying a high initial unthreading torque and a high final threading torque between successive drill pipes, means for rapid screwing and unscrewing of successive drill pipes, and a clamping machanism including a bolster and a plurality of shims, said shims having outer portions tapered to fit into said opening of said turntable and having inner portions with a shape corresponding to the shape of the drill pipes, each shim being supported individually on the bolster by powered means for moving the shim into engagement with a drill pipe to grip the same and with sufficient freedom to permit the shims to center the pipe between them automatically, and means for lowering the bolster to cause the shims already gripping the pipe to enter the opening in the turntable, and wherein said bolster is permanently open at one side thereof to permit a drill pipe to be laterally moved into or out of a space between said shims, and wherein said means for supporting each shim individually comprises a jack and a link, one end of the jack and one end of the link being pivotally connected to the bolster and the other end of the jack and the other end of the link being pivotally connected to the shim.

* * * * *